US005327810A

United States Patent [19]

Sandusky et al.

[11] Patent Number: 5,327,810

[45] Date of Patent: Jul. 12, 1994

[54] UNIVERSAL RECEIVER HAVING PNEUMATIC SAFE/ARM/FIRING MECHANISM

[75] Inventors: Harold W. Sandusky, Laurel; John M. Kelley, Owings Mills, both of Md.

[73] Assignee: The United States of America as represented by the Secretary of the Navy, Washington, D.C.

[21] Appl. No.: 166,397

[22] Filed: Dec. 3, 1993

[51] Int. Cl.[5] ..... F41A 19/08; F41A 19/55

[52] U.S. Cl. ..... 89/273; 89/14; 89/22.12; 42/70.08

[58] Field of Search ..... 89/27.3, 1.4, 27.12; 42/70.05, 70.08

[56] References Cited

U.S. PATENT DOCUMENTS 2,168,114 8/1939 Boussel ..... 89/1.4
2,408,680 10/1946 Pontius ..... 89/1.4
2,814,971 12/1957 Fitzgibbon ..... 89/1.4

FOREIGN PATENT DOCUMENTS 481512 3/1938 United Kingdom ..... 89/1.4

*Primary Examiner*—Stephen M. Johnson
*Attorney, Agent, or Firm*—John D. Lewis; Jacob Shuster

[57] ABSTRACT

A universal receiver having a pneumatic safe/arm/firing mechanism is provided. The receiver comprises a receiver shell with a threaded barrel clampnut on one end and a threaded breech plug assembly on the opposite end. The breech plug assembly includes a cocking and striker piece and a pneumatically-operated sear. A separate pneumatically-operated safety bar interlocks with the cocking and striker piece to prevent inadvertent firing. A multi-port pneumatic valve is connected to sequentially operate the safety bar retractor followed by the sear retraction, thereby firing the gun.

6 Claims, 2 Drawing Sheets

UNIVERSAL RECEIVER HAVING PNEUMATIC SAFE/ARM/FIRING MECHANISM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The present invention relates generally to gun receivers and actions and more particularly to pneumatically or hydraulically-controlled and/or triggered receivers and actions.

BACKGROUND OF THE INVENTION

During the qualification of energetic materials (i.e., explosives, propellants, gas generants, pyrotechnics) for various types of ammunition (e.g., bombs, warheads, rockets, power devices), various methods are employed to characterize the reaction violence of the energetic material to such unplanned-for stimuli as dropping or enemy fire. In one test to characterize impact sensitivity, a universal receiver fitted with a standard test barrel is employed to fire a sample of energetic material with a known velocity at a nearby steel target plate. The impact of the energetic material sample upon the plate, which is usually recorded via high-speed cinematography, results in a violent reaction of the material, the degree or extent of which is used as a guide for further material development. Because of the close proximity of the target, the violent reaction and the potential for high-velocity flying debris, the operator is remotely located during gun firing. However, current devices require the operator to provide hands-on arming and safing of the test gun assembly.

The arming/safing procedure requires the operator to connect a device for pulling the sear and for moving the cocking piece from the SAFE position to the ARM position, or in the event of a misfire, from the FIRE position to the SAFE position. These hands-on procedures subject the operator to a potential injury in the event of accidental firing of the test assembly due to either mechanical defect or operator procedural error. Because the projectiles are developmental energetic materials whose sensitivities may not be fully understood, electrically-actuated solenoids or other electrical safe/arm devices are unsuitable, as any stray electrical currents may initiate the projectile material in the presence of the operator. Additionally, although the high-speed cameras are physically isolated from the test assembly, they are electrically controlled. Spurious electrical noise emanating from an electrical safe/arm device might cause the cameras or other data-recording devices to operate at an inopportune moment, thereby causing valuable data to be lost.

SUMMARY OF THE INVENTION

It is an object of the invention to provide a safe/arm-/firing mechanism suitable for use with highly energetic material.

It is another object of the invention to provide a safe/arm/firing mechanism for a universal receiver having a remote operating mechanism.

It is yet another object of the invention to provide a safe/arm/firing mechanism having an electrically non-conducting connection to its actuating power source.

In accordance with the foregoing and other objects, a universal receiver having pneumatic safe/arm/firing mechanism is provided. The universal receiver and safe/arm/firing mechanism in one embodiment, is attached to a 12-gauge shotgun barrel. The receiver assembly comprises a receiver shell having a barrel clampnut on one end and a breech plug on the opposite end. The breech plug contains a striker assembly which is controlled by a pneumatically-operated sear and safetied by a pneumatically-operated safety bar mechanism.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
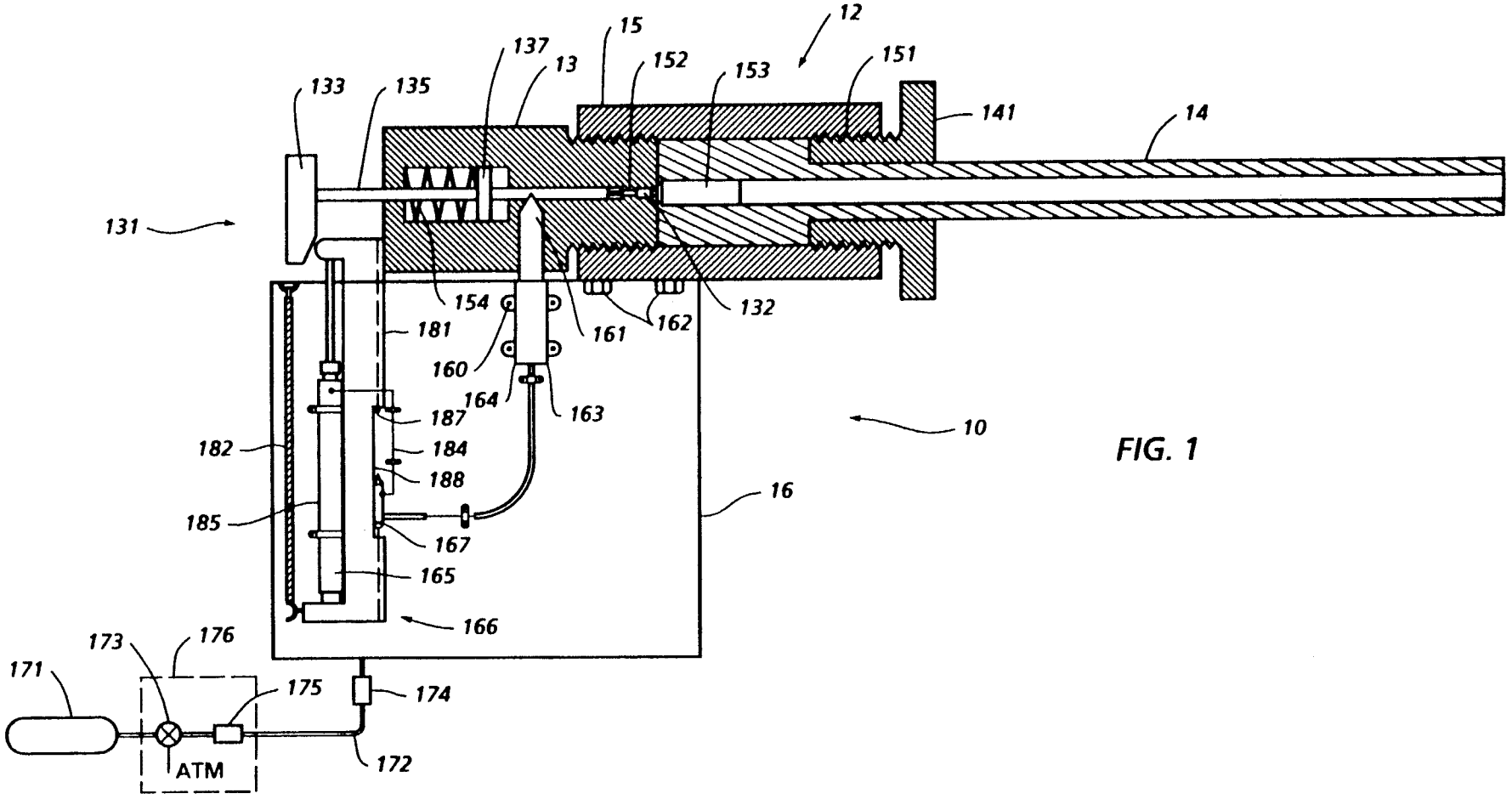
FIG. 1 is a cross-sectional view of the universal receiver assembly showing the receiver in either the SAFE or ARMED mode with striker cocked.

Referring now to FIG. 1, the pneumatic safe/arm/firing mechanism of the present invention, designated generally by the reference numeral 10, is shown attached to a universal receiver assembly 12. The receiver assembly 12 is attached to a 12-gauge shotgun barrel 14.

The universal receiver assembly 12 is a conventional and known receiver assembly comprising a receiver shell 15 having a female-threaded end 151 and a female-threaded end 152. A barrel clampnut 141 is screwed into the receiver shell 15 at end 151 and secures the barrel 14 inside the receiver shell. A cartridge 153 is shown for reference.

A breech plug assembly 13 is threaded into receiver shell end 152 and contains the striker and cocking piece 131. The striker and cocking piece 131 is shown in the armed and safe position with the firing pin 132 retracted away from the cartridge 153, firing spring 154 compressed, and sear 161 engaging the striker and cocking piece 131. The striker and cocking piece 131 has a cocking handle 133 attached to a striker shaft 135 which has a collar 137 affixed to engage the firing spring 154. Mounting plate 16 is attached to the receiver shell 15 using bolts 162.

The mounting plate 16 provides a surface for attachment of the sear operating cylinder 163, the safety retract assembly 166 containing the safety retract cylinder 165, and the multi-port pneumatic control valve 167. Multi-port pneumatic control valve 167 is supplied with low-pressure air (less than 100 psig) from tank 171 which is remotely mounted to avoid any damage by explosive debris. Non-conducting valve supply line 172 is routed to a pneumatic quick-disconnect fitting 174 on the side of mounting plate 16. Said fitting serves as a hard-attach point for the supply line and as an optional pneumatic safety disconnect. Plate 16 is drilled to provide a passage for the low pressure air to the pneumatic control valve 167. Connection of this passage to the pneumatic control valve 167 is by standard pneumatic fittings and tubing. A two-position shut-off valve 173 allows remote operation of the air pressure reaching the multi-port control valve 167. When valve 173 is in the shut-off position, low pressure air otherwise trapped within valve supply line 172 is vented to the atmosphere. Said valve 173 is equipped with a pneumatic quick-disconnect fitting 175 located inside a locked box 176. As a safety measure, the system operator retains the key to box 176 on his person at all times such that connection of the valve supply line 172 to the valve 173 can be accomplished only when the box 176 has been opened by said operator.

With no air pressure applied, the safety bar 181 is extended to the safe position by safety return spring 182. With air pressure applied, control valve 167 directs air pressure through supply line 184 to safety retract cylinder 185. As the safety bar 181 reaches the fully retracted position, the adjustable snubber 187 engages switch 188 on control valve 167, thereby re-directing air flow to pneumatic sear operating cylinder 163. The entire sear assembly 164 comprises the operating cylinder 163, the sear 161 and the sear spring 160.

Figure 2:
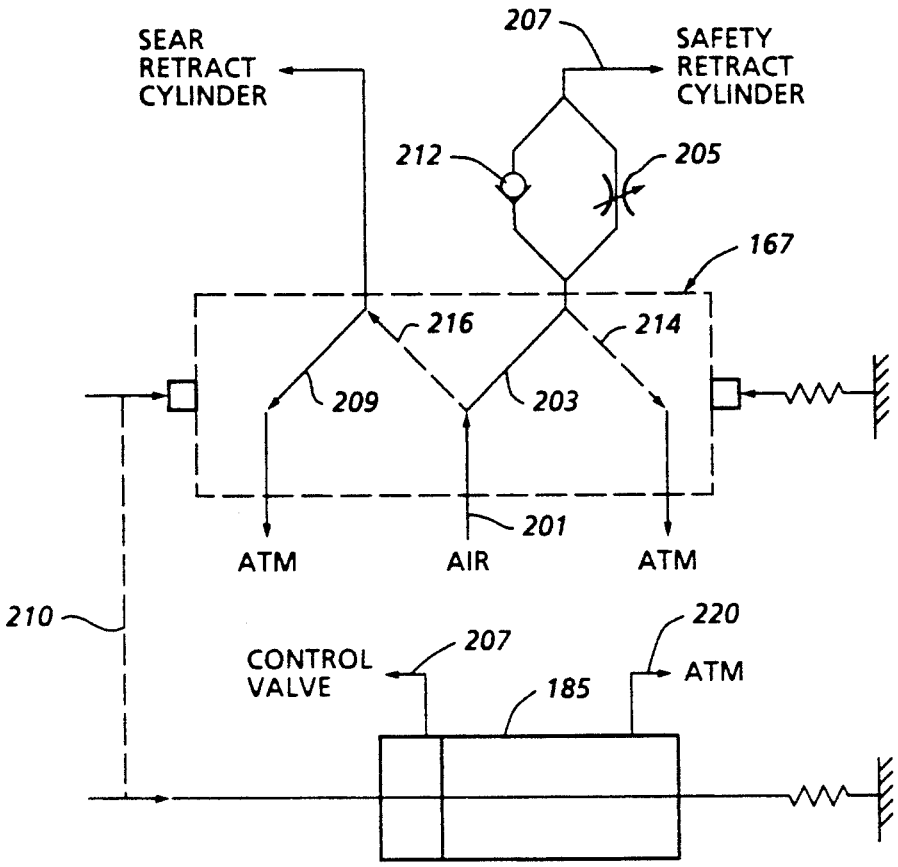
FIG. 2 is a schematic view of the integrated control assembly for the sear and safety cylinders.

The multi-port control valve 167 shuttle can be switched only at the extremes of travel of the safety bar and safety retract cylinder. This feature is critical to the safety of the design. That is, the gun cannot fire once the safety bar is blocking the striker. Furthermore, the fully-retracted position of the safety bar is the major qualifying/enabling criterion for disengagement of the sear. Moreover, should the safe/arm/fire mechanism have to function safely in a difficult environment (e.g., high vibration), an alternative embodiment, designed to ensure that the valve shuttle is bi-stable, has mechanical detents incorporated in the shuttle. Operation of the control valve 167 may be seen in FIG. 2, wherein a diagram shows the functional relationships between the safety retract cylinder 185 and the control valve 167. Air pressure is supplied to control valve 167 at the inlet port 201. With the safety bar in the extended (safe) position, air flow is directed as shown by the solid lines, low pressure air via line 203 to the safety retract cylinder 185 through integrated check and needle valve 205 and check valve 212 and further to line 207. In this flow direction most of the motive air is directed through the check valve 212. Line 207 extends from the control valve 167 to safety retract cylinder 185 as depicted (the actual connection of the line is not shown in order to maintain the clarity of the drawing).

At the same time that air is directed to the safety retract cylinder 185, the sear retract cylinder (not shown in the diagram) is vented to atmospheric pressure via line 209. This venting insures that no air pressure is applied to the sear until full retraction of the safety retract bar and that any residual pressure in the sear cylinder is vented.

As the safety retract cylinder reaches the retracted position, the mechanical connection 210 causes control valve 167 to switch to the sear retract position with air flow as shown by the dotted lines. Low pressure air in the safety retract cylinder is slowly vented through adjustable restriction 205 and further through line 214 to atmospheric pressure (ATM). Adjustment of metered restriction 205 permits tailoring the extension time of safety retract cylinder 185 and safety bar 181. In this flow direction, all of the exhaust from line 207 must flow through the metered restriction 205 because the check valve 212 closes in this direction of flow. It is the adjustment feature of metered restriction 205 (in concert with the spring rate, k, of the safety return spring 182) that permits tailoring the extension time of safety retract cylinder 185 and safety bar 181 (which are slaved together). Thus, proper adjustment of metered restriction 205 ensures that when firing is intended, the striker 131 can fall and fire the cartridge 153 before the safety bar 181 can intercept it. As the safety retract cylinder is gradually extended, under the net influence of the safety return spring 182 and the controlled exhaust flow through metered restriction 205, the control valve 167 which is shifted only at the extremes of travel of the safety bar and safety retract cylinder, remains in the position shown by the dotted lines. Low pressure air is directed via line 216, thereby retracting the sear and firing the cartridge. Also shown is a vent 220 for relieving pressure on the non-working side of the safety retract cylinder.

Figure 3:
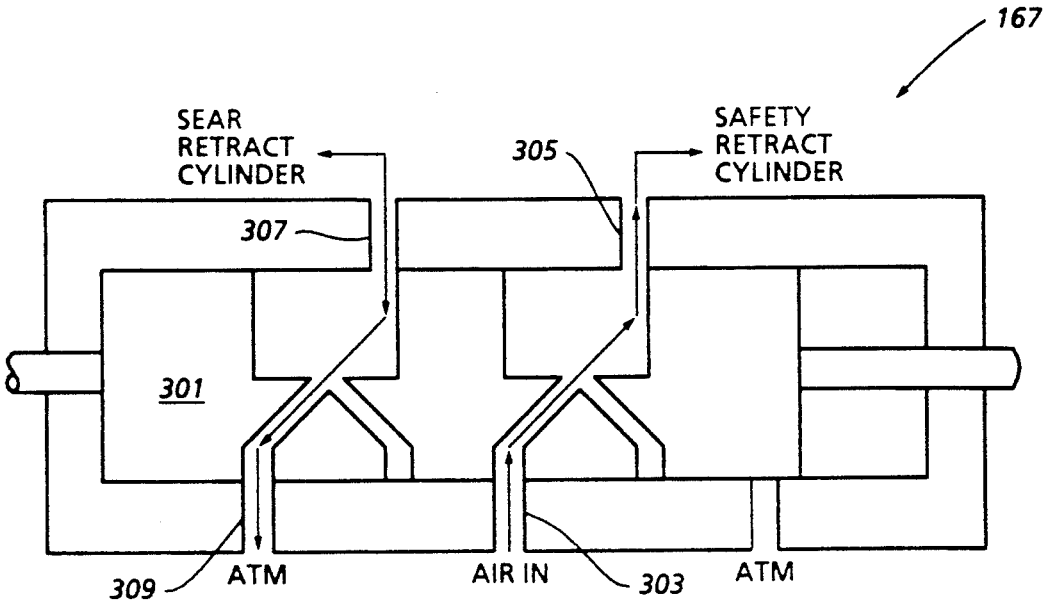
FIG. 3 is a cross sectional view of the multi-port control valve showing the physical structure of the valve.

Referring now to FIG. 3, a representation of the physical structure of the control valve 167 is shown. Valve shuttle 301 is shown in the extended position, thereby connecting air-in port 303 to safety retract port 305. At the same time, the sear retract cylinder is vented through sear retract port 307 to atmospheric pressure port 309. This valve position matches the position shown in FIG. 2 with solid lines. When the safety retract cylinder approaches the limit of its travel, the mechanical interconnect moves the valve shuttle to the right, thereby venting the safety retract cylinder to atmospheric pressure and applying low pressure air to the sear retract cylinder. The safety bar extends under spring pressure to the safe position, but is restricted by the restrictor valve so that the sear retraction and gun firing is complete well before safety bar extension is complete. At the sound of the shot (or from instrumentation data indicating the shot has been delivered), the position of valve 173 is changed. This removes motive air from port 303 of the control valve and vents line 172 to the atmosphere. Under the net influence of its return spring 182, the safety bar 181 extends. Again, to ensure that the gun striker 131 falls before the safety bar can extend, intercept the cocking piece 133, and thereby prevent gun firing, the flow of air in the exhaust direction (i.e., from the safety bar retract cylinder 185 to the atmosphere) is metered through the adjustable restriction 205 so as to retard the extension of the bar. This permits sufficient time for striker fall to occur. With the striker in the 'fired' position, the safety bar clears the cocking piece and extends fully. In this position, the control valve shuttle 301 is shifted to the initial position shown in FIG. 3, and the system is again at rest.

The advantages and features of the invention are numerous. The pneumatic system allows safing and arming of the system without the dangers of inadvertent firing due to stray or induced electrical currents. Similarly, the pneumatic sear retraction mechanism allows firing of the system without electrical devices. Additionally, the air system is remotely located so that any ricocheted or flying debris cannot damage the air pressure tank. Further, in the event of any malfunction in the system or a misfire, either the safety bar or sear cylinder will be vented to atmospheric pressure, thereby allowing extension under spring pressure. These advanced safety features are necessary to insure operator safety when firing explosive projectiles in the typical short range test setups.

Although the invention has been described relative to a specific embodiment thereof, there are numerous variations and modifications that will be readily apparent to those skilled in the art in the light of the above teachings. For example, the invention herein is specifically designed to operate while isolated within a bombproof structure. Because of the action of the projectile exploding within the structure, camera coverage of the operation of the safe/arm/firing device is not practical. However, the pneumatic operation of the device allows monitoring directly by use of fluidic sensors or further safing is desired. It is therefore to be understood that, within the scope of the appended claims, the invention may be practiced other than as specifically described.

What is claimed as new and desired to be secured by Letters Patent of the United States is:

1. A universal receiver for a standard barrel comprising:

a receiver shell having a female-threaded first end and a female-threaded second end;

a barrel clampnut threadably attached to the first end of said receiver shell;

a breech plug assembly, threadably attached to the second end of said receiver shell;

a mounting plate attached to said universal receiver;

a sear assembly, mounted on said mounting plate and further mechanically linked to said breech plug assembly;

a pneumatic safety retract assembly mounted on said mounting plate and engaging in said breech plug assembly; and a multi-port pneumatic control valve connected to and operating said sear assembly and said pneumatic safety assembly.

2. A universal receiver as in claim 1 wherein said breech plug assembly comprises:

a striker shaft having a first and second ends;

a cocking handle attached to the first end of said striker shaft;

a firing pin attached to the second end of said striker shaft;

a collar attached to said striker shaft; and a spring engaging said collar and urging said striker shaft toward a firing position.

3. A universal receiver as in claim 1 wherein said sear assembly comprises:

a pneumatic sear operating cylinder;

a sear attached to said operating cylinder; and a sear spring attached to and urging said sear toward an extended position.

4. A universal receiver as in claim 1 wherein said pneumatic safety assembly comprises:

a safety retract cylinder;

an extendible safety bar attached to said pneumatic retract cylinder; and a spring attached to said extendable safety bar urging it toward an extended position.

5. A universal receiver as in claim 1 wherein said multiport pneumatic valve comprises a five-port valve having a sliding valve shuttle providing both operating pressure and venting to two separate operating ports.

6. A universal receiver for a standard gun barrel comprising:

a receiver assembly;

means for mounting attached to said receiver assembly;

a pneumatically-operated safety retract assembly mounted on said means for mounting;

a pneumatically-operated sear assembly mounted on said means for mounting; and means for sequentially operating said pneumatically-operated safety retract assembly and said pneumatically-operated sear assembly.

* * * * *